US007753418B2

(12) United States Patent
Fleming

(10) Patent No.: US 7,753,418 B2
(45) Date of Patent: Jul. 13, 2010

(54) LEVER ACTUATED DOOR LATCH OPERATOR

(75) Inventor: Paul D. Fleming, Glendale, CA (US)

(73) Assignee: W & F Manufacturing, Inc., Sun Valley, CA (US)

( * ) Notice: Subject to any disclaimer, the term of this patent is extended or adjusted under 35 U.S.C. 154(b) by 734 days.

(21) Appl. No.: 11/538,175

(22) Filed: Oct. 3, 2006

(65) Prior Publication Data

US 2007/0080541 A1 Apr. 12, 2007

Related U.S. Application Data

(60) Provisional application No. 60/724,647, filed on Oct. 6, 2005.

(51) Int. Cl.
*E05B 3/00* (2006.01)
*E05C 1/00* (2006.01)

(52) U.S. Cl. ..... 292/336.3; 292/32; 292/37; 292/38; 292/42; 292/63; 292/65; 292/67; 292/347; 70/224

(58) Field of Classification Search ..... 292/32, 292/33, 37, 38, 42, 63–69, 336.3, 347, DIG. 31, 292/DIG. 716; 70/208, 210, 224
See application file for complete search history.

(56) References Cited

U.S. PATENT DOCUMENTS 243,374 A * 6/1881 Howard ..... 292/48
1,059,952 A * 4/1913 Spooner ..... 292/336.3
1,516,628 A * 11/1924 Blackwell ..... 292/39
2,135,799 A * 11/1938 Crosley, Jr. ..... 292/336.3
2,321,724 A * 6/1943 Aldeen et al. ..... 292/336.3
3,287,054 A * 11/1966 Russell et al. ..... 292/336.3
4,583,775 A * 4/1986 Bisbing ..... 292/64
5,088,778 A * 2/1992 Lin ..... 292/336.3
5,290,077 A 3/1994 Fleming
5,388,875 A 2/1995 Fleming
5,524,941 A 6/1996 Fleming
5,524,942 A 6/1996 Fleming
5,542,720 A 8/1996 Fleming
5,700,044 A * 12/1997 Wartian ..... 292/336.3
6,116,660 A * 9/2000 Langkamp et al. ..... 292/65
6,357,268 B1 * 3/2002 Takimoto ..... 70/208
6,418,761 B1 * 7/2002 Wytcherley et al. ..... 70/208
6,843,082 B2 * 1/2005 Vickers ..... 70/83
7,441,427 B2 * 10/2008 Vickers ..... 70/127

* cited by examiner

*Primary Examiner*—Carlos Lugo
(74) *Attorney, Agent, or Firm*—Kelly Lowry & Kelley, LLP; Stuart O. Lowry

(57) ABSTRACT

A door latch operator includes a hand grip actuator lever for retracting one or more latch bolts mounted at a free side edge of a door, such as an entry door for a residence or place of business. The actuator lever is pivotally mounted at an inboard side of a manually grasped handle for grasping and squeezing with the fingers against the door handle to operate a torque converter or cam module for indexing a rotary cam through a rotary step. The rotary cam is coupled to a latch bolt retractor mechanism for retracting the latch bolt or bolts and thereby permit opening of the door. In a preferred form, the latch bolt retractor mechanism operates multiple latch bolts mounted along the free side edge of the door.

17 Claims, 9 Drawing Sheets

LEVER ACTUATED DOOR LATCH OPERATOR

BACKGROUND OF THE INVENTION

This invention relates generally to improvements in door latch and related latch bolt operators for retracting one or more latch bolts on a door, such as an entry door for a residence or business establishment. More specifically, this invention relates to an improved door latch operator designed primarily for use with a multipoint latch bolt system of the general type disclosed in U.S. Pat. No. 5,290,077, wherein multiple latch bolts are mounted along a free side edge of the door for respective engagement with multiple associated strike sets on the adjacent doorjamb. The door latch operator of the present invention facilitates concurrent operative retraction of multiple latch bolts to accommodate relatively quick and easy opening of the door.

Door latch and lock assemblies for use with hinged swinging doors are generally known in the art, and typically include at least one movable lock member mounted at a selected vertical position along a free side edge of the door in proximity with an actuator positioned for convenient manual access and operation. For example, a spring-loaded latch bolt is normally mounted on the door at a mid-height position to engage a strike or keeper plate mounted on the adjacent doorjamb, to retain the door in a normal closed position. A rotary handle or lever is commonly included as part of the latch and lock assembly, and is adapted for manual rotation to retract the latch bolt from the strike plate and thereby permit the door to be opened. In some door hardware designs, such as typically higher-end hardware, the rotary handle or lever is replaced by a relatively large and more decorative fixed handle in combination with a relatively small actuator lever positioned for thumb-depression to retract the latch bolt. These lock assemblies further include at least one lock device which may be designed to preclude latch bolt retraction in the locked condition, and/or may comprise a separate dead bolt for use in selectively locking the door.

Although such conventional door latch and lock assemblies as described above have generally performed their latching and/or locking functions in a satisfactory manner, there has been an on-going desire and need for further improvements in entry door security for residences and business establishments. Toward this end, so-called multipoint lock assemblies have been developed wherein multiple lock members such as multiple retractable latch bolts are provided at vertically spaced positions along the free side edge of the door for engaging a corresponding number of strike plates mounted at corresponding positions on the adjacent doorjamb. In some designs, the multiple lock members are adapted for independent actuation, with the unfortunate result that frequently only one of the lock members is engaged due to human forgetfulness and/or neglect. In other designs, the multiple lock members are adapted for concurrent actuation by means of a single rotary-mounted operator handle or lever.

U.S. Pat. No. 5,290,077 discloses an exemplary multipoint door lock assembly including multiple retractable latch bolts mounted at vertically spaced positions along the free side edge of an entry door or the like. A primary latch bolt is positioned generally at a mid-height location in close proximity with an actuator mechanism. A pair of secondary latch bolts are respectively positioned vertically above and below the primary latch bolt, and are linked by slide-mounted extension rods with the actuator mechanism. A rotary-mounted lever handle or the like at an outboard side of the door is manually grasped and rotated to operate the actuator mechanism to retract all three latch bolts in a concurrent manner. When the rotary lever handle is released, one or more springs incorporated into the actuator mechanism causes the latch bolts (and lever handle) to return automatically to a normal extended position. As is known in the art, each latch bolt normally includes one tapered face to accommodate automatic retraction as the latch bolt engages the associated strike plate during door closure movement, followed by automatic spring-loaded re-extension of the latch bolt into a strike plate keeper recess as the door reaches the closed position.

Multipoint door lock assemblies of the type shown and described in U.S. Pat. No. 5,290,077 beneficially provide enhanced security against unauthorized entry or tampering, as well as improved door engagement with associated weatherstripping and the like, and further provide enhanced secure closure in response to relatively high wind loads. As such, these multipoint door lock assemblies are becoming increasingly popular. However, such multipoint mechanisms inherently require a significantly increased application of manual effort or manual force in order to retract the multiple latch bolts, in comparison with a traditional single latch bolt system. This requirement for increased manual actuation force is a particular problem with certain, typically higher-end and increasingly popular door hardware of the type having a large fixed handle and a relatively small thumb-depressed lever actuator. In particular, in such higher-end hardware styles, persons having limited physical strength may be unable to apply sufficient force to the thumb lever to open the door.

There exists, therefore, a need for further improvements in and to door latch operators particularly of the type adapted for concurrently retracting multiple latch bolts in a multipoint system of the shown and described in U.S. Pat. No. 5,290,077, wherein the door latch operator can be opened quickly and easily, and in an intuitively apparent manner, by application of a relatively modest or normal actuation force to facilitate operation by virtually any user. The present invention fulfills these needs and provides further related advantages.

SUMMARY OF THE INVENTION

In accordance with the invention, an improved door latch operator is provided for retracting at least one and preferably multiple latch bolts mounted at a free side edge of a door, such as an entry door for a residence or business establishment. The door latch operator comprises an elongated hand grip style actuator lever mounted at an inboard side of a fixed handle secured to a door at a position proximate to the door free side edge. The actuator lever is pivotally movable toward the fixed handle by grasping and squeezing with the fingers to retract the latch bolts. More particularly, the actuator lever is manually drawn against the door handle to operate a torque converter or cam module for indexing a rotary cam through a rotary step. The rotary cam is coupled to a latch bolt retractor mechanism for retracting the latch bolts and thereby permit opening of the door.

In a preferred form, the torque converter or cam module includes a bearing lifter coupled between the pivotally mounted actuator lever and the rotary cam. Manual drawing of the actuator lever toward and/or against the inboard side of the fixed handle is accompanied by sliding retraction of the bearing lifter relative to the rotary cam. The bearing lifter carries at least one lift member such as a guide roller that is slidably and/or rollingly seated with an arcuate cam slot formed in the rotary cam, and the rotary cam is in turn constrained within a torque housing for substantially coaxial rotatable displacement therein. Accordingly, manual retraction of the bearing lifter relative to the rotary cam causes the at least one guide roller to engage and rotatably displace the rotary cam within the torque housing. In other words, substantially linear sliding retraction of the bearing lifter is converted to rotary index motion of the rotary cam.

A drive hub such as a non-circular or square drive socket on the rotary cam engages a mating driven member such as a square drive key on the latch bolt retractor mechanism for transmitting rotary displacement of the rotary cam to the retractor mechanism, thereby retracting the latch bolts. In the preferred form, the latch bolt retractor mechanism may be constructed according to U.S. Pat. No. 5,290,077, which is incorporated by reference herein.

The elongated hand grip style actuator lever beneficially provides door latch operator with a substantial mechanical advantage, whereby the multiple latch bolts can be retracted by input of a relatively minimum or modest manual force. In addition, the squeeze-type hand grip actuator lever is conducive to intuitive manipulation. The invention may be adapted for use in a right-hand or left-hand configuration with a swinging door adapted to swing inwardly or outwardly relative to an associated door frame. The arcuate cam slot formed in the rotary cam can be designed with a suitable cam angle, or a variably changing cam angle appropriate for manipulating the mechanism with the desired relatively minimum or modest manual force.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
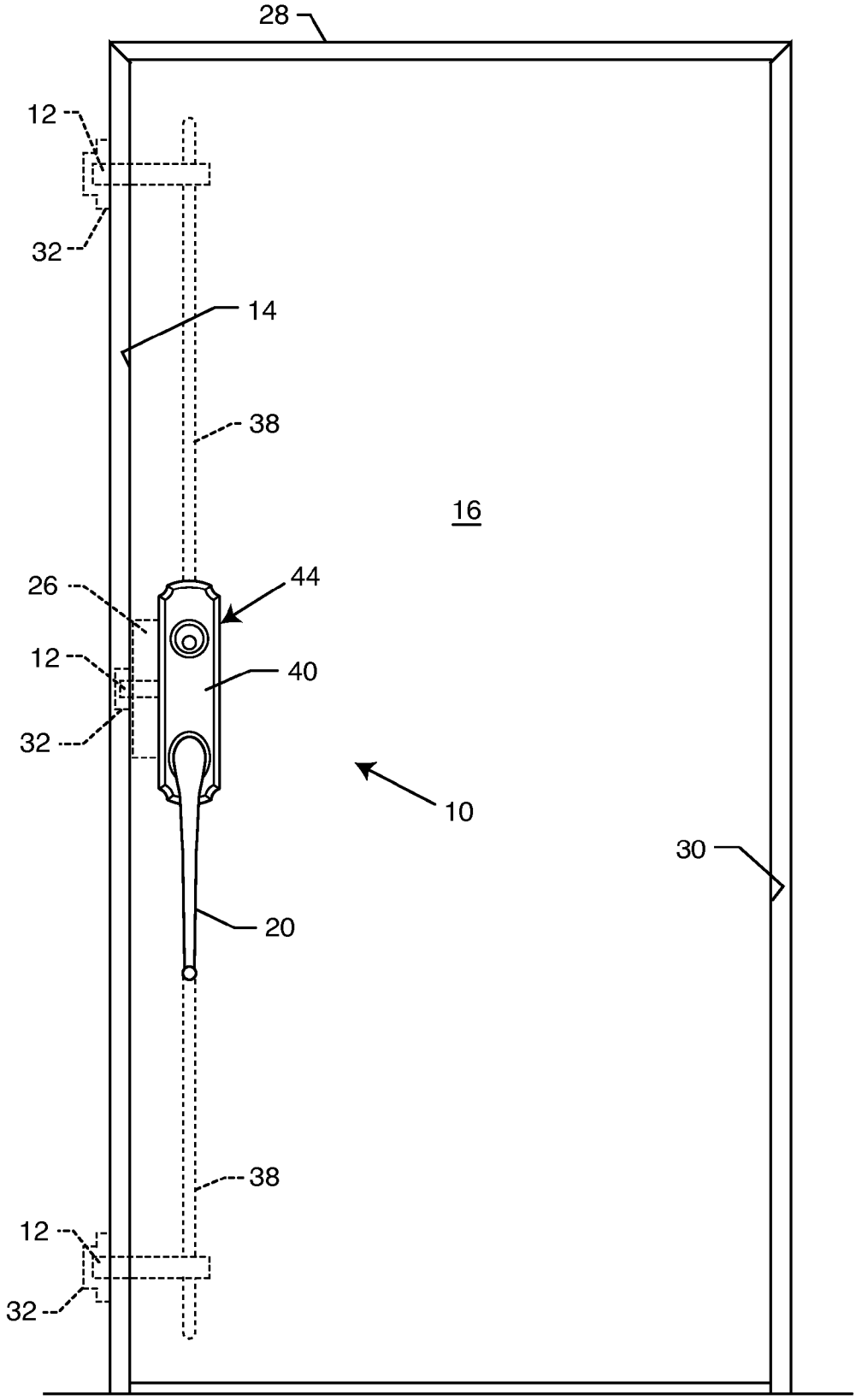
FIG. 1 is a front elevation view illustrating an outboard side of a door equipped with an improved lever actuated door latch operator constructed in accordance with one preferred form of the present invention, for use in retracting multiple latch bolts mounted on a free side edge of the door.
Figure 2:
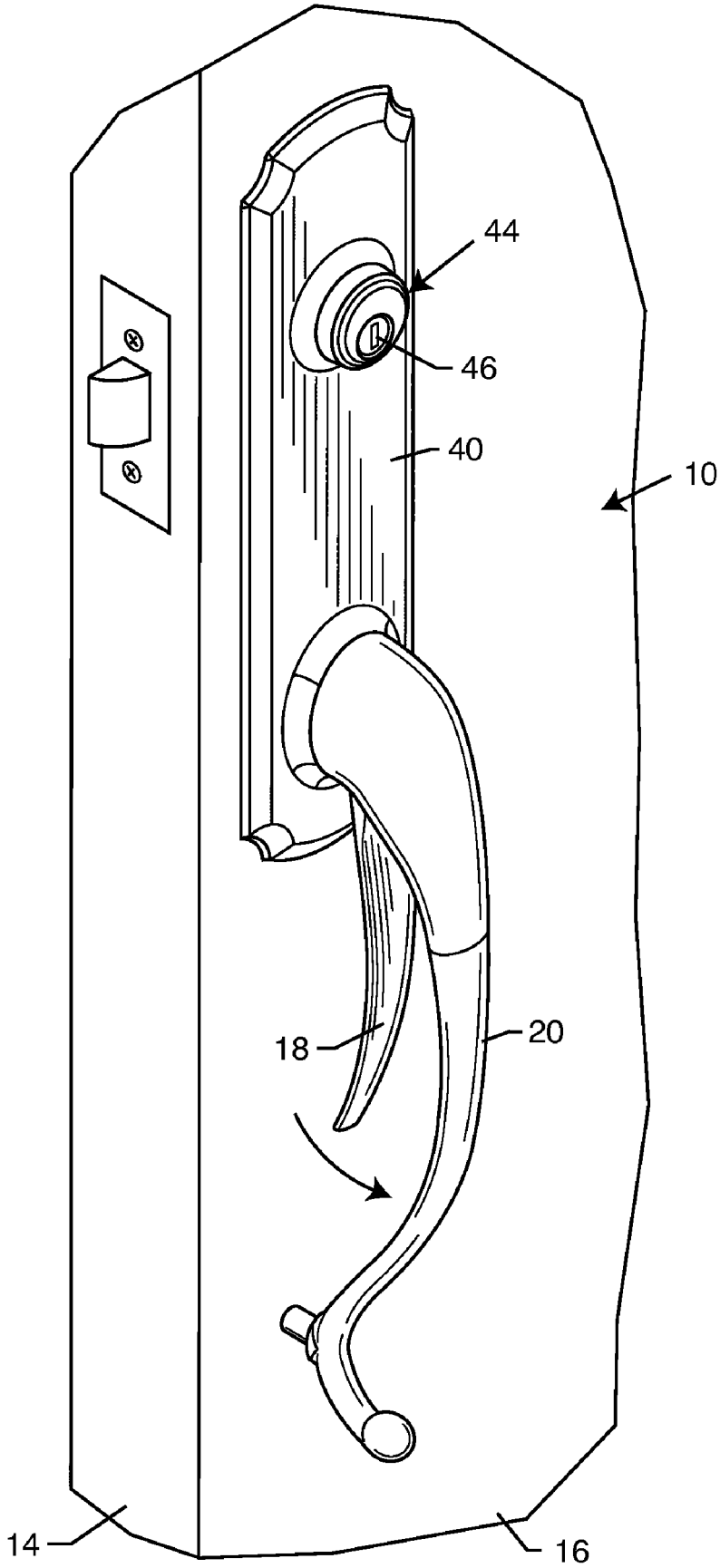
FIG. 2 is an enlarged and fragmented outboard side perspective view of the lever actuated latch operator of FIG. 1.
Figure 11:
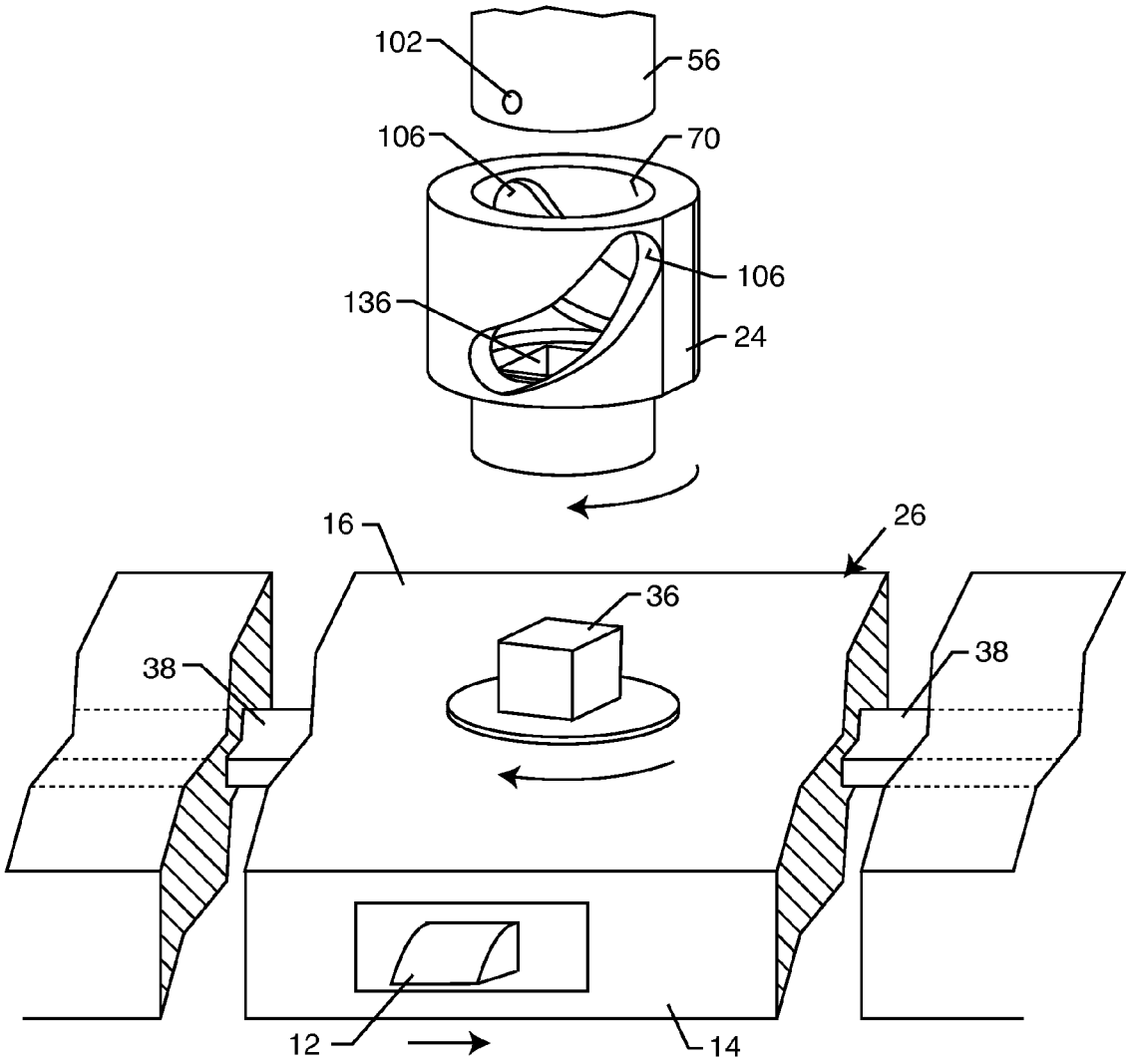
FIG. 11 is a fragmented and exploded perspective view illustrating rotation of a slotted cam forming a portion of the cam module, in drive engagement with a driven hub for operating a latch bolt retractor mechanism.

As shown in the exemplary drawings, an improved door latch operator referred to generally by the reference numeral 10 in FIG. 1 is provided for retracting at least one and preferably multiple latch bolts 12 mounted at a free side edge 14 of a door 16, such as an entry door for a residence or place of business. The door latch operator 10 includes a hand grip style actuator lever 18 (FIG. 2) mounted at an inboard side of an elongated and typically decorative fixed handle 20 on an outboard side of the door 16, at a position proximate to the free side edge 14 thereof. The actuator lever 18 is manually graspable for drawing or squeezing toward and/or against an inboard side of the fixed handle 20, for operating a torque converter or cam module 22 (FIGS. 3-7) to index a rotary cam 24 through a rotational increment. The rotary cam 24 is coupled in turn with a latch bolt retractor mechanism 26 (FIGS. 1, 3 and 11) for retracting the multiple latch bolts 12.

The illustrative door 16 comprises a hinged door installed within a doorjamb or frame 28 by means of conventional hinges (not shown) mounted at the side edge 30 opposite the free side edge 14. The latch bolts 12 are carried at the free side edge 14 of the door 16, to protrude outwardly therefrom for engagement with corresponding strike or keeper plates 32 mounted on the adjacent doorjamb. These latch bolts 12 are normally or conventionally spring-loaded to protrude outwardly from the door free side edge, and incorporate one angled or tapered face so that the latch bolts may retract upon door closure followed by automatic re-extension in engagement with the associated strike plates 32. As shown, one of the latch bolts 12 is positioned at a conventional, substantially mid height location along the door free side edge 14, with two additional latch bolts 12 being positioned near the top and bottom of the door 16. While the illustrative drawings show the invention installed in a right-hand configuration on a door adapted to swing inwardly, persons skilled in the art will understand that the invention may be employed with suitable adaptation in a right-hand or left-hand configuration on a door adapted for swinging inwardly or outwardly.

The latch bolt retractor mechanism 26 is carried at or near the door free side edge 14 and comprises a mechanism for retracting the multiple latch bolts 12 in substantial unison, thereby permitting the door to be opened. In the preferred form as shown, the latch bolt retractor mechanism 26 comprises a primary cartridge installed within the door free side edge at a position proximate to the mid height latch bolt 12. The retractor mechanism 26 further includes a driven member 36 (FIGS. 3 and 11) such as the illustrative square drive key. Rotatable driving of this key 36 operates an internal mechanism within the cartridge for retracting the mid height latch bolt 12, and also for displacing upper and lower extension rods 38 (FIGS. 1, 3 and 11) for concurrently retracting the upper and lower latch bolts 12. While the details of the mechanism internal to the primary cartridge, and the details of the extension rod linkage to the upper and lower latch bolts are not shown and described herein, preferred mechanisms are disclosed in U.S. Pat. No. 5,290,077 which is incorporated by reference herein. See also the multi-point door latch system marketed by W&F Manufacturing, Inc. of Glendale, Calif. under the name Trilennium 3000 Series. Persons skilled in the art will recognize and appreciate that other and alternative latch bolt retractor mechanisms are known in the art and may be employed.

The door latch operator 10 of the present invention provides a simple and intuitively actuated mechanism for rotatably displacing the driven member 36 such as the square drive key of the latch bolt retractor mechanism 26, for retracting the multiple latch bolts 12 so that the door can be opened. Importantly, the hand grip style actuator lever 18 has an elongated shape to provide a substantial mechanical advantage, so that the latch bolts 12 can be quickly and easily retracted by the input of a relatively minimum or modest manual force. The invention thus enables persons having limited or minimum manual strength to operate the multiple latch bolts 12.

Figure 3:
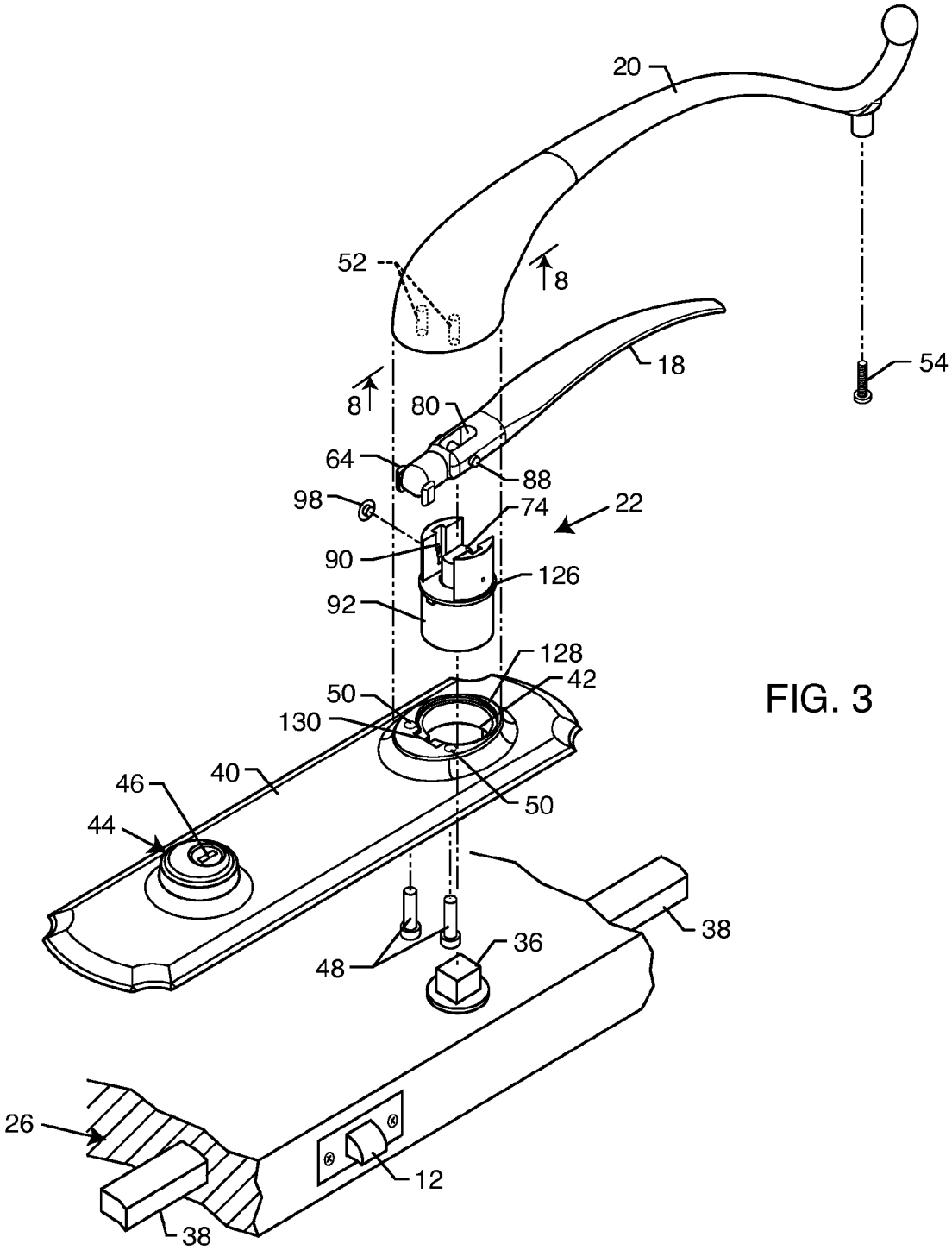
FIG. 3 is an exploded perspective view showing components of the door latch operator, including an outboard side escutcheon, an outboard side fixed door handle, and a hand grip style actuator lever for operating a cam module to retract at least one and preferably multiple latch bolts protruding from a free side edge of the door.

As shown generally in FIG. 3, the door latch operator 10 includes the actuator lever 18 and the cam module 22 mounted on or otherwise assembled with a door handle unit having the elongated fixed handle 20. As shown, an escutcheon plate 40 mounted, e.g., on an outboard side of the door 16 has a primary bore 42 formed therein to accommodate slide-fit mounting of the cam module 22, to be described in more detail herein. The escutcheon plate 40 may also include a secondary bore to accommodate installation of a standard deadbolt unit 44 adapted, e.g., for external operation by means of an exposed key slot 46, and for internal operation by means of a thumbturn (not shown) or the like. Alternately, persons skilled in the art will recognize that the secondary bore may accommodate mounting of a keyed cylinder (not shown) for displacing the latch bolts 12 into a deadbolt locking position.

The fixed handle 20 is secured relative to the escutcheon plate 40 as by means of one or more screws 48 fastened from the escutcheon plate inboard side through screw ports 50 into blind-ended threaded bores 52 formed in an upper end of the handle 20. A lower end of the handle 20 may be secured to the door 16, at a positioned spaced vertically below the escutcheon plate 40 as by means of an additional screw 54 fastened through the door. Between its upper and lower ends, the fixed handle 20 defines an elongated central segment spaced from the outboard side of the door 16 by a distance sufficient for easy manual grasping and gripping to pull and/or push the door between open and closed positions.

In general terms, an upper end of the elongated actuator lever 18 is pivotally coupled to the fixed handle 20, and extends downwardly therefrom generally at an inboard side of the fixed handle. The actuator lever 18 is thus positioned for easy manual grasping with the fingers, whenever the fixed handle 20 is grasped. The actuator lever 18 can be pivotally retracted or drawn in a direction toward the inboard side of the fixed handle 20 to operate the cam module 22. In general terms, the torque converter or cam module 22 comprises a bearing lifter 56 (FIG. 4) linked to the actuator lever 18 for retraction therewith, and the rotary cam 24 is coupled between the bearing lifter 56 and the driven member such as the square drive hub 36. The rotary cam 24 converts the substantially linear retraction motion of the bearing lifter 56 to a rotary displacement increment for driving the hub 36 in a direction retracting latch bolts 12.

Figure 7:
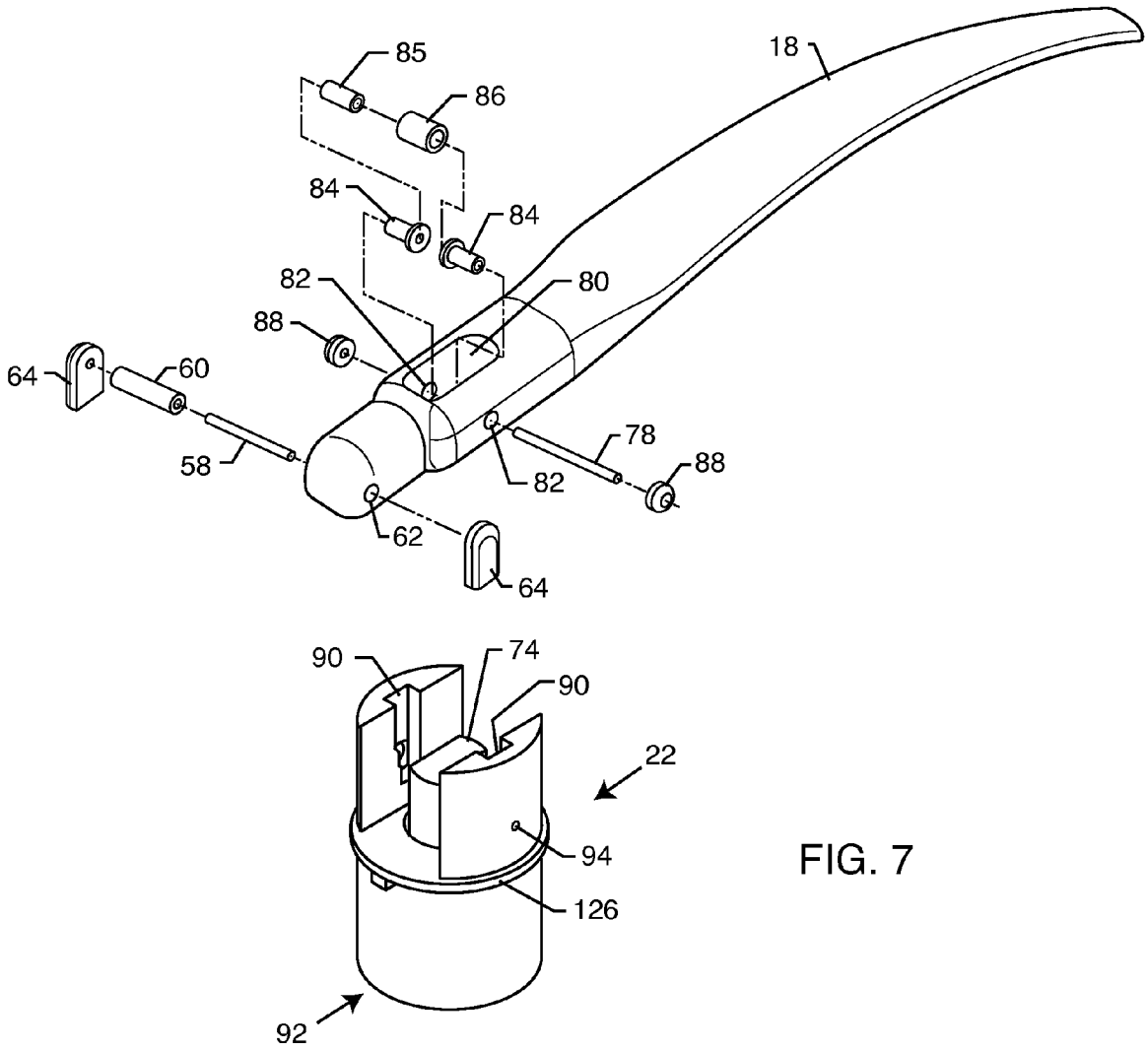
FIG. 7 is an enlarged and exploded sectional view showing assembly of the hand grip style actuator lever with the cam module.
Figure 8:
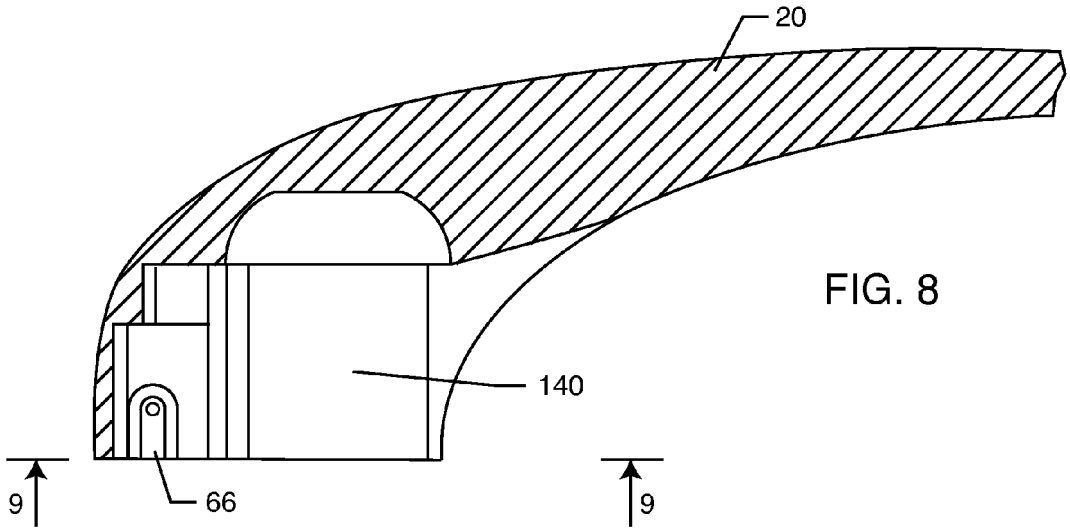
FIG. 8 is an enlarged and fragmented vertical sectional view of a portion of the outboard side door handle, taken generally on the line 8-8 of FIG. 3.
Figure 9:
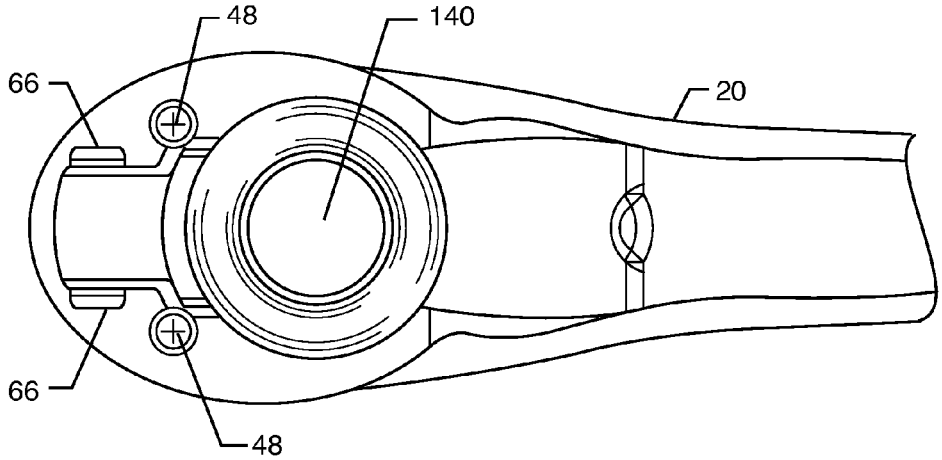
FIG. 9 is a fragmented inboard side elevation view of a portion of the door handle, taken generally on the line 9-9 of FIG. 8.

More particularly, as shown best in FIGS. 3 and 7, the upper end of the elongated actuator lever 18 is pivotally coupled to the upper end of the fixed handle 20 as by means of a transversely extending dowel pin 58 having a rotary bushing sleeve 60 carried thereon (if required for reduced friction), and extending transversely through a port 62 formed in the lever upper end. Opposite ends of the dowel pin 58 are seated within a pair of pivot bushings 64 having a size and shape for sliding, non-rotating fit into a mating shaped pair of nose cavities 66 (FIGS. 8-9) formed within the inboard side of the handle upper end.

Figure 4:
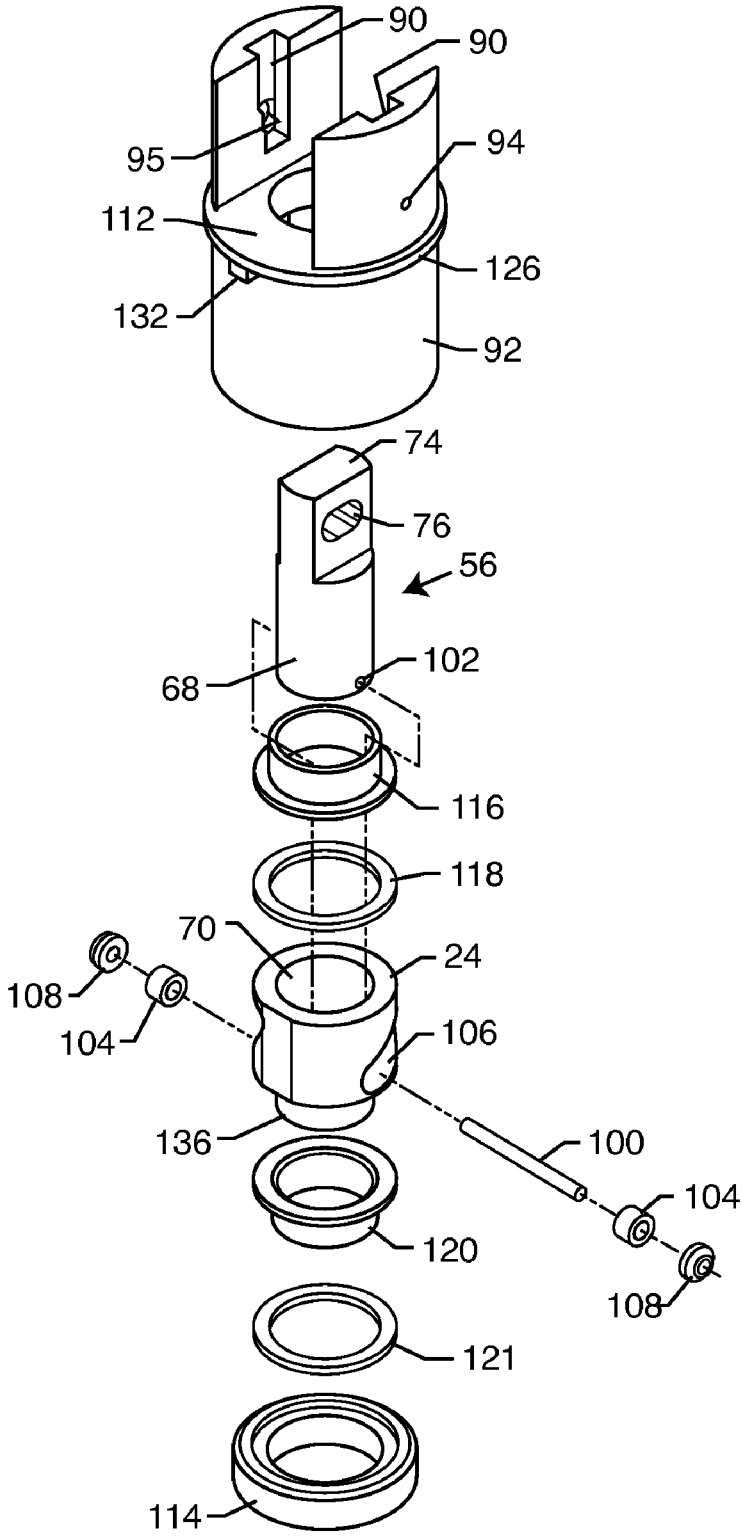
FIG. 4 is an enlarged and exploded perspective view showing assembly of components forming the cam module.

The bearing lifter 56 comprises a plug-shaped element having a generally cylindrical lower body 68 slidably fitted into the rotary cam 24 which defines an internal cavity 70 of generally mating size and shape (FIG. 4). An upper end of the bearing lifter 56 defines a short upstanding, and flat-faced lug 74 having a transversely open aperture 76 of enlarged size and shape. The bearing lifter lug 74 is coupled to the actuator lever 18 by means of a lift axle 78 (FIG. 7) carried by the actuator lever 18.

Figure 10:
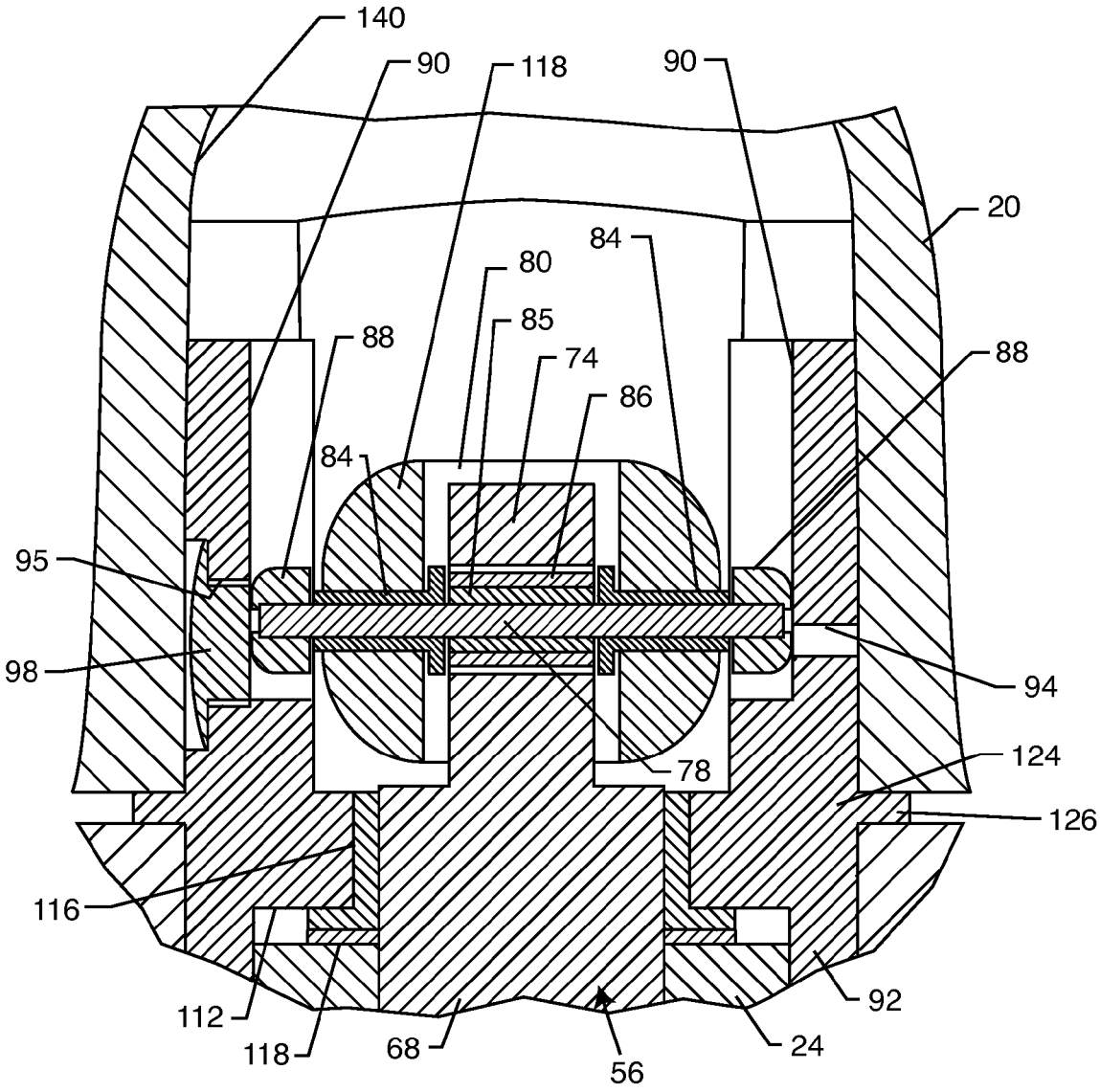
FIG. 10 is an enlarged and fragmented vertical sectional view showing assembly of the door handle, actuator lever, and cam module.

FIGS. 7 and 10 show the actuator lever 18 to include an open yoke passage 80 formed therein at a position spaced a short distance below the upper end and associated pivotal connection to the handle 20. A pair of transversely aligned ports 82 are formed in the lever 18 at opposite sides of this yoke passage 80 for seated reception of the lift axle 78 which extends transversely therebetween. Suitable bushings 84 anchor the axle pin 78 within these ports 82. Importantly, the span of the lift axle 78 extending transversely through the yoke passage 80 carries roller sleeves 85 and 86 positioned within the transversely open aperture 76 in the bearing lifter lug 74. In addition, the opposite ends of the lift axle 78 protrude outwardly beyond the lever 18 at opposite sides of the yoke passage 80, and carry upper guide rollers 88 having a size and shape for slide-guide reception into upwardly open upper guide slots 90 formed in an upper end of a generally cylindrical torque housing 92.

FIG. 10 shows a pair of different sized assembly ports 94 and 95 formed in the torque housing 92 near lower ends of the guide slots 90, with the assembly port 95 having a larger diametric size which is larger than the associated guide roller 88. These ports 94, 95 facilitate component assembly, e.g., as by fitting a small guide pin (not shown) through the smaller port 94 to assist in aligning components during assembly as by slide-fit reception through the larger port 95. A plug 98 of plastic or like can be press-fitted into the larger port 95 to retain the components in assembled relation. As shown, each guide roller 88 has a stepped bore formed therein to receive the associated end of the lift axle 78 at the inboard side thereof, but to prevent the lift axle 78 from protruding axially beyond the outboard side of the guide roller 88 thereby preventing lift axle contact with the walls of the guide slots 95.

With this construction, the actuator lever 18 is pivotally movable about the axis of the dowel pin 58 toward and away from the inboard side of the fixed handle 20. Such movement is accompanied by a similar movement of the bearing lifter 56 toward and away from the handle 20, and thus also in and out relative to the escutcheon plate 40 and the door 16. The axle pin 78 and associated roller sleeves 84, 86 within the lug aperture 76 provide this displacement of the bearing lifter 56.

As noted previously herein, the bearing lifter 56 is slidably fitted within the cylindrical rotary cam 24. A cam axle 100 (FIGS. 4 and 5) is carried at a lower or inboard end of the bearing lifter 56 to extend transversely through and to protrude a short distance from a transversely open axle port 102. These protruding opposite ends of the cam axle 100 carry a pair of first or inner guide rollers or bushings 104 positioned within a corresponding pair of arcuate cam slots or cam tracks 106 formed in the rotary cam 24, as well as a pair of second or outer guide members such as guide rollers or bushings 108 positioned within a corresponding pair of lower guide slots 110 (FIG. 5) formed in a lower region of the torque housing 92 and disposed generally in vertical alignment with the upper guide slots 90 formed therein. Thus, the outer guide rollers 108 cooperate with the above-discussed upper guide rollers 88 to constrain the bearing lifter 56 to substantially linear motion along the associated guide slots 90, 110. Similar to upper guide rollers 88, the lower guide rollers or bushings 108 also include stepped bores formed therein for receiving the associated ends of the cam axle 100, while preventing the axle ends from contacting the walls of the slots 110.

The linear displacement of the bearing lifter 56, in response to actuator lever movement, is translated to rotary motion of the rotary cam 24 as the inner guide rollers 104 translate along the arcuate slots or tracks 106 formed in the rotary cam 24. In this regard, the cam slots 106 are shaped for rotary displacement in a direction to retract the latch bolts 12 upon manual squeezing of the actuator lever 18 toward and/or against the inboard side of the fixed handle 20, and for spring-loaded return movement of the latch bolts 12 to the advanced position when the actuator lever 18 is released. In the most preferred form of the invention, the cam slots 106 are tailored to provide a changing cam angle for maximum mechanical advantage when required to initiate latch bolt retraction movement, and for reducing the cam angle as the lift load decreases. As previously noted, the cam slots 106 as shown in the illustrative drawings are oriented for a right-hand swinging door configuration. Persons skilled in the art will appreciate that alternative door configurations may be used, wherein substitution of an appropriately configured rotary cam 24 provides easy adaptation of the invention for different door configurations.

Figure 5:
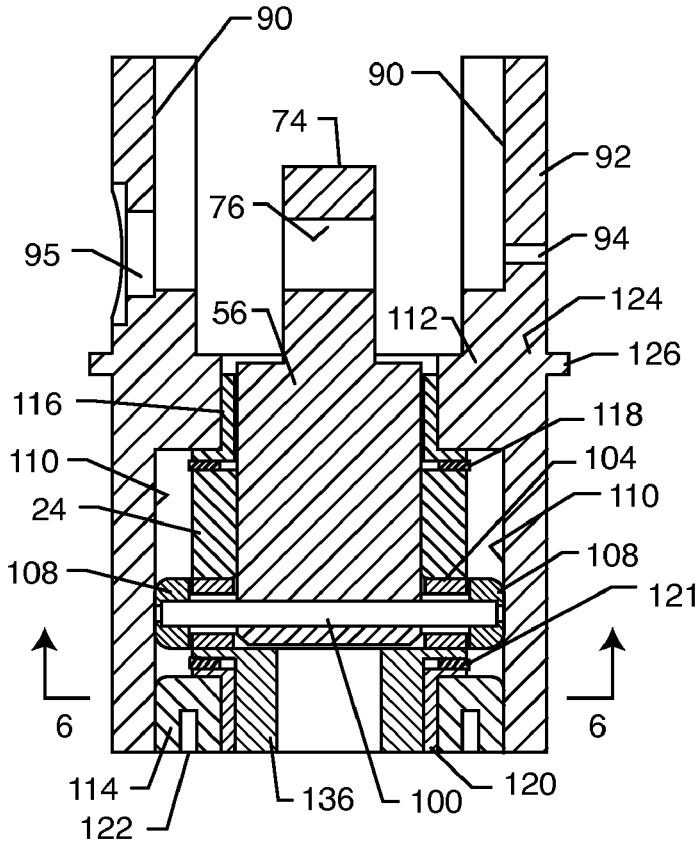
FIG. 5 is an enlarged vertical sectional view of the assembled cam module.
Figure 6:
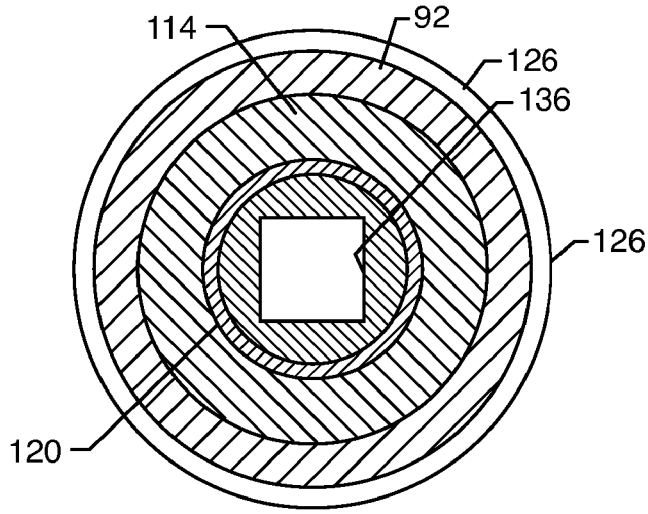
FIG. 6 is a transverse sectional view taken generally on the line 6-6 of FIG. 5.

As shown in FIGS. 5 and 6, the rotary cam 24 is rotatably carried within a lower region of the torque housing 92, between a central radially inwardly protruding land 112, and a lower retainer nut 114 fastened as by threading into the lower end of the torque housing 92. An upper bushing 116 and slip washer 118 support the upper end of the cam 24 relative to the landing 112, whereas a lower bushing 120 and slip washer 121 supports the lower end of the cam 24 relative to the retainer nut 114. These components cooperatively constrain the rotary cam 24 against axial motion within the torque housing 92. The underside of the retainer nut 114 may include spanner wrench ports 122 (FIG. 5) for facilitated installation.

A circumferential rim or rib 126 is formed about the torque housing 92 generally at a mid height location, for removably installing the assembled torque converter or cam module 22 within the primary bore 42 (FIG. 4) in the escutcheon plate 40. A secondary ring groove 128 (FIGS. 3 and 10) is formed within this escutcheon plate bore 128 to receive the rib 126. This secondary ring groove 128 overlies a small alignment notch 130 formed within the bore 128 for seated reception of an alignment tab 132 (FIGS. 4 and 7) protruding radially outwardly from the torque housing 92. Alternately, if desired, the integrally-formed circumferential rib 126 and tab 132 on the torque housing 92 can be replaced by a separately mounted snap ring (not shown) and pin (also not shown).

Rotational displacement of the rotary cam 24 drives a drive member 136 such as a square drive socket (FIGS. 5, 6 and 11) at the lower end of the cam 24. This square drive socket 136 slidably or press-fit receives the square drive key 36 (FIGS. 3 and 11) of the latch bolt retractor mechanism 26. Accordingly, the cam 24 rotatably drives the retractor mechanism 26 to retract the latch bolts 12, in response to manual retraction of the actuator lever 18 and the associated lift bearing 56.

FIG. 10 shows the upper end of the fixed handle 20 having a generally concave or shell-shaped cavity 140 that is open in an inboard direction for overlying and substantially concealing the pivoted upper end of the actuator lever 18 and associated connector/lifter mechanisms from view.

A variety of further modifications and improvements in and to the improved door latch operator 10 of the present invention will be apparent to those persons skilled in the art. Accordingly, no limitation on the invention is intended by way of the foregoing description and accompanying drawings, except as set forth in the appended claims.

What is claimed is:

1. A door latch assembly, comprising:

at least one latch bolt retractably protruding from a door free side edge;

a latch bolt retractor mechanism including a rotatably mounted driven member for controllably retracting said at least one latch bolt; and a door latch operator including:

a handle fixed to one side of the door, with a segment of said handle disposed in spaced relation to the door;

an actuator lever pivotally carried by said handle generally at an inboard side thereof for manual grasping with the fingers when said handle is manually grasped, said actuator lever being manually pivotally retractable in a direction toward said inboard side of said handle; and a torque converter coupled between said actuator lever and said rotatably driven member, said torque converter including a drive member rotatably driven in response to pivotal retraction of said actuator lever for driving the rotatable driven member to retract said at least one latch bolt;

said torque converter comprising a bearing lifter constrained against rotation and axially movable upon pivoting movement of said actuator lever, and a rotary cam constrained against axial displacement and rotatably movable with said drive member, said rotary cam defining at least one arcuate cam track, and said bearing lifter including at least one guide member engaged with said at least one cam track, whereby axial movement of said bearing lifter rotatably displaces said rotary cam.

2. The door latch operator of claim 1 wherein said at least one arcuate cam track defines a substantially maximum cam angle for substantially maximum mechanical advantage upon initial displacement of said latch bolt retractor mechanism to retract said at least one latch bolt, said cam angle progressively decreasing for reducing the mechanical advantage upon progressive further displacement of said latch bolt retractor mechanism to progressively further retract said at least one latch bolt.

3. The door latch operator of claim 1 wherein said at least one arcuate cam track comprises a pair of arcuate cam tracks, and further wherein said bearing lifter includes a pair of said guide members engaged respectively with said pair of cam tracks.

4. The door latch operator of claim 1 wherein said guide member comprises a guide roller.

5. The door latch operator of claim 1 wherein said actuator lever is pivotally coupled generally at one end thereof to said handle, and wherein said torque converter further includes a lift axle coupling said bearing lifter to said actuator lever at a position spaced from the pivotal connection of said actuator lever to said handle.

6. The door latch operator of claim 1 wherein said torque converter further comprises a torque housing mounted on the door, said rotary cam being rotatably mounted within said torque housing, and said bearing lifter being reciprocally mounted within said torque housing.

7. The door latch operator of claim 6 wherein said torque housing and said bearing lifter include cooperative means for constraining said bearing lifter against rotation relative to said torque housing.

8. The door latch assembly of claim 1 wherein said at least one latch bolt comprises a plurality of latch bolts retractably protruding from the door free side edge, and further wherein said latch bolt retractor mechanism controllably retracts said plurality of latch bolts.

9. In a door having at least one latch bolt retractably protruding from a door free side edge, and a latch bolt retractor mechanism responsive to a rotatable driven member for controllably retracting said at least one latch bolt, a door latch operator, comprising:

a handle fixed to the door and including a segment disposed in spaced relation to the door;

an actuator lever pivotally carried by said handle generally at an inboard side thereof for manual grasping with the fingers when said handle is manually grasped, said actuator lever being manually pivotally retractable in a direction toward said inboard side of said handle; and a torque converter coupled between said actuator lever and said rotatable driven member, said torque converter including a drive member rotatably driven in response to pivotal retraction of said actuator lever for driving the rotatable driven member to retract said at least one latch bolt;

said torque converter including a bearing lifter constrained against rotation and axially movable in response to pivoting movement of said actuator lever, and a rotary cam constrained against axial displacement and rotatably movable with said drive member, said rotary cam defining at least one arcuate cam track, and said bearing lifter including at least one guide member engaged with said at least one cam track, whereby reciprocal movement of said bearing lifter rotatably displaces said rotary cam.

10. The door latch operator of claim 9 wherein said handle includes upper and lower ends secured to one side of the door, said segment disposed in spaced relation to the door comprising a central segment of said handle.

11. The door latch operator of claim 9 wherein said latch bolt retractor mechanism controllably retracts a plurality of latch bolts retractably protruding from the door free side edge.

12. The door latch operator of claim 9 wherein said at least one arcuate cam track defines a substantially maximum cam angle for substantially maximum mechanical advantage upon initial displacement of said latch bolt retractor mechanism to retract said at least one latch bolt, said cam angle progressively decreasing for reducing the mechanical advantage upon progressive further displacement of said latch bolt retractor mechanism to progressively further retract said at least one latch bolt.

13. The door latch operator of claim 9 wherein said at least one arcuate cam track comprises a pair of arcuate cam tracks, and further wherein said bearing lifter includes a pair of said guide members engaged respectively with said pair of cam tracks.

14. The door latch operator of claim 9 wherein said guide member comprises a guide roller.

15. The door latch operator of claim 9 wherein said actuator lever is pivotally coupled generally at one end thereof to said handle, and wherein said torque converter further includes a lift axle coupling said bearing lifter to said actuator lever at a position spaced from the pivotal connection of said actuator lever to said handle.

16. The door latch operator of claim 9 wherein said torque converter further comprises a torque housing mounted on the door, said rotary cam being rotatably mounted within said torque housing, and said bearing lifter being reciprocally mounted within said torque housing.

17. The door latch operator of claim 16 wherein said torque housing and said bearing lifter include cooperative means for constraining said bearing lifter against rotation relative to said torque housing.

* * * * *